US009156143B2

(12) United States Patent
Chiriac

(10) Patent No.: US 9,156,143 B2
(45) Date of Patent: Oct. 13, 2015

(54) ADJUSTABLE RATCHETING SOCKET TOOL

(71) Applicant: Horatiu Daniel Chiriac, Montreal (CA)

(72) Inventor: Horatiu Daniel Chiriac, Montreal (CA)

( * ) Notice: Subject to any disclaimer, the term of this patent is extended or adjusted under 35 U.S.C. 154(b) by 0 days.

(21) Appl. No.: 14/274,027

(22) Filed: May 9, 2014

(65) Prior Publication Data

US 2014/0331823 A1 Nov. 13, 2014

Related U.S. Application Data

(60) Provisional application No. 61/822,535, filed on May 13, 2013.

(51) Int. Cl.
*B25B 13/46* (2006.01)
*B25B 13/44* (2006.01)

(52) U.S. Cl.
CPC ..... *B25B 13/44* (2013.01); *B25B 13/463* (2013.01); *B25B 13/465* (2013.01)

(58) Field of Classification Search
CPC B25B 13/463; B25B 23/0035; B25B 13/465; B25B 13/44; B25B 23/005
USPC ..... 81/60–63.2
See application file for complete search history.

(56) References Cited

U.S. PATENT DOCUMENTS

| | | | | | |
|---|---|---|---|---|---|
| 458,079 | A * | 8/1891 | Thorn | 81/62 |
| 597,043 | A * | 1/1898 | Webster | 81/63.1 |
| 897,584 | A * | 9/1908 | Carlson | 81/63.1 |
| 1,200,430 | A * | 10/1916 | Rosenstein | 81/59.1 |
| 1,492,466 | A * | 4/1924 | Jarmolowsky | 279/7 |
| 2,573,421 | A * | 10/1951 | Feiring | 81/318 |
| 3,713,322 | A * | 1/1973 | Fischer | 72/409.09 |
| 4,793,225 | A * | 12/1988 | Berkich | 81/356 |
| 5,207,130 | A * | 5/1993 | Payne | 81/90.2 |
| 5,249,490 | A * | 10/1993 | Kennel | 81/405 |
| 5,261,263 | A * | 11/1993 | Whitesell | 72/409.19 |
| 5,740,704 | A * | 4/1998 | Payne | 81/60 |
| 5,819,607 | A * | 10/1998 | Carnesi | 81/128 |
| 5,893,306 | A * | 4/1999 | Owoc | 81/60 |
| 6,073,522 | A * | 6/2000 | Carnesi | 81/128 |
| 6,098,226 | A * | 8/2000 | Lin | 7/165 |
| 6,575,058 | B1 * | 6/2003 | Mitchell | 81/59.1 |
| 6,971,284 | B2 * | 12/2005 | Owoc | 81/58.2 |
| 7,318,365 | B2 * | 1/2008 | Huang | 81/128 |
| 7,878,092 | B1 * | 2/2011 | Eby et al. | 81/112 |
| 7,992,470 | B2 * | 8/2011 | Brown | 81/90.2 |
| 8,833,209 | B2 * | 9/2014 | Brown | 81/90.2 |
| 2008/0072718 | A1 * | 3/2008 | Liu | 81/438 |
| 2014/0144294 | A1 * | 5/2014 | Row | 81/111 |

* cited by examiner

*Primary Examiner* — Hadi Shakeri
*Assistant Examiner* — Danny Hong
(74) *Attorney, Agent, or Firm* — Gowling Lafleur Henderson LLP; Benoit Yelle

(57) ABSTRACT

A ratcheting tool and a method of using the same, the ratcheting tool being formed by a handle, a substantially perpendicular cylinder and a ratcheting mechanism. The cylinder is adapted to be positioned over a nut or bolt head and comprises jaws adapted to engage the nut or bolt head when pushed laterally theretowards. When the arm is squeezed with the handle, a slider block is pushed towards the nut or bolt head causing the jaws to laterally engage the nut or bolt head. The ratcheting mechanism is between the cylinder and the jaws and allows torque to be applied to the nut or bolt head in a desired direction when the handle is moved in a circular motion around the main axis of the cylinder. The jaws are allowed to rotate within the cylinder in a direction opposite to the desired direction.

8 Claims, 14 Drawing Sheets

ADJUSTABLE RATCHETING SOCKET TOOL

TECHNICAL FIELD

The present invention relates to hand tool and, more specifically, to a ratcheting tool.

BACKGROUND

Ratcheting tools with interchangeable socket exists. Each sockets corresponds to a specific nut size.

Adjustable grip tools exist that can fit different nut sizes, but they fail to provide ratcheting.

Accordingly, a need for an adjustable ratcheting tool is perceived.

SUMMARY

A first aspect of the present invention is directed to an apparatus for tightening or un-tightening a nut on a bolt. The apparatus comprises a handle with an arm, a cylinder substantially perpendicular to the handle and a ratcheting mechanism. The cylinder and the handle need to form an angle that is sufficient to allow force from the rotation of the handle to be transferred to the cylinder. The cylinder is adapted to be positioned over a nut or bolt head and comprises jaws adapted to engage the nut or bolt head when pushed laterally thereto-wards. When the arm is squeezed with the handle, a slider block is pushed, e.g., perpendicularly or at a slight angle, towards the nut or bolt head. The perpendicular movement is translated in a lateral movement of the jaws that engage the nut or bolt head. The ratcheting mechanism is between the cylinder and the jaws and allows torque to be applied to the nut or bolt head in a desired direction when the handle is moved in a circular motion around the main axis of the cylinder. The jaws are allowed to rotate within the cylinder in a direction opposite to the desired direction.

Optionally, the ratcheting mechanism is positioned within the cylinder, on the same plane of the nut or bolt head. The slider block may also comprise three downward diagonal prisms each engaging one of the jaws within a diagonal sliding channel. The jaws would then move inwardly by sliding within the sliding channels when the slider block is pushed perpendicularly towards the nut or bolt head.

A second aspect of the present invention is directed to a method for, using a device, tightening or un-tightening a nut on a bolt. the method comprises (a) engaging the nut or bolt head in a cylinder of the device by pressing an arm of the device towards a handle of the device, thereby causing a pusher assembly within the cylinder to descend causing jaws within the cylinder to move inwardly until they reach and tighten around the nut or bolt head, (b) while a ratcheting mechanism of the device is engaged in an active position, rotating the device in a first direction in which the nut or bolt head is rotated by the device while allowing rotation of the device in a second direction without the nut or bolt head being rotated and (c) releasing the arm, thereby causing the pusher assembly to move up and the jaws to move away from the nut or bolt head.

Optionally, the method may further comprise, before or after (a), switching the ratcheting mechanism of the device into the active position. After (c), they method may also comprise switching the ratcheting mechanism of the device from the active position into a second active position. The method may then also comprise, after (d), (e) engaging the nut or bolt head in a cylinder of the device by pressing an arm of the device towards a handle of the device, thereby causing a pusher assembly within the cylinder to descend causing jaws within the cylinder to move inwardly until they reach and tighten around the nut or bolt head, (f) rotating the device in the second direction in which the nut or bolt head is rotated by the device while allowing rotation of the device in the first direction without the nut or bolt head being rotated and (g) releasing the arm, thereby causing the pusher assembly to move up and the jaws to move away from the nut or bolt head.

BRIEF DESCRIPTION OF THE DRAWINGS

Further aspects and advantages of the present invention will become better understood with reference to the description in association with the accompanying drawings in which.

DETAILED DESCRIPTION

The present invention relates to a ratcheting tool that can adjust to nuts of different sizes. The following description illustrates one exemplary embodiment of the invention. Skilled person will readily understand that different components could be used to achieve the same result.

In the illustrated embodiment, a ratcheting tool is formed by a handle and perpendicular cylinder. The cylinder is adapted to be positioned over a nut or bolt head. The cylinder comprises jaws adapted to engage the nut or bolt head when pushed laterally theretowards. The handle is equipped with an arm. When the arm is squeezed towards the handle, a lever causes a slider block to be pushed, e.g., perpendicularly or at a slight angle, towards the nut or bolt head. The slider block engages the jaws laterally towards the nut or bolt head. The cylinder also comprises a ratcheting mechanism that allows torque to be applied to the nut or bolt head in a desired direction when the handle is moved in a circular motion around the main axis of the cylinder. Optionally, the ratcheting mechanism may be positioned within the cylinder and may optionally further be positioned on the same plane of the nut or bolt head, as illustrated.

Figure 1:
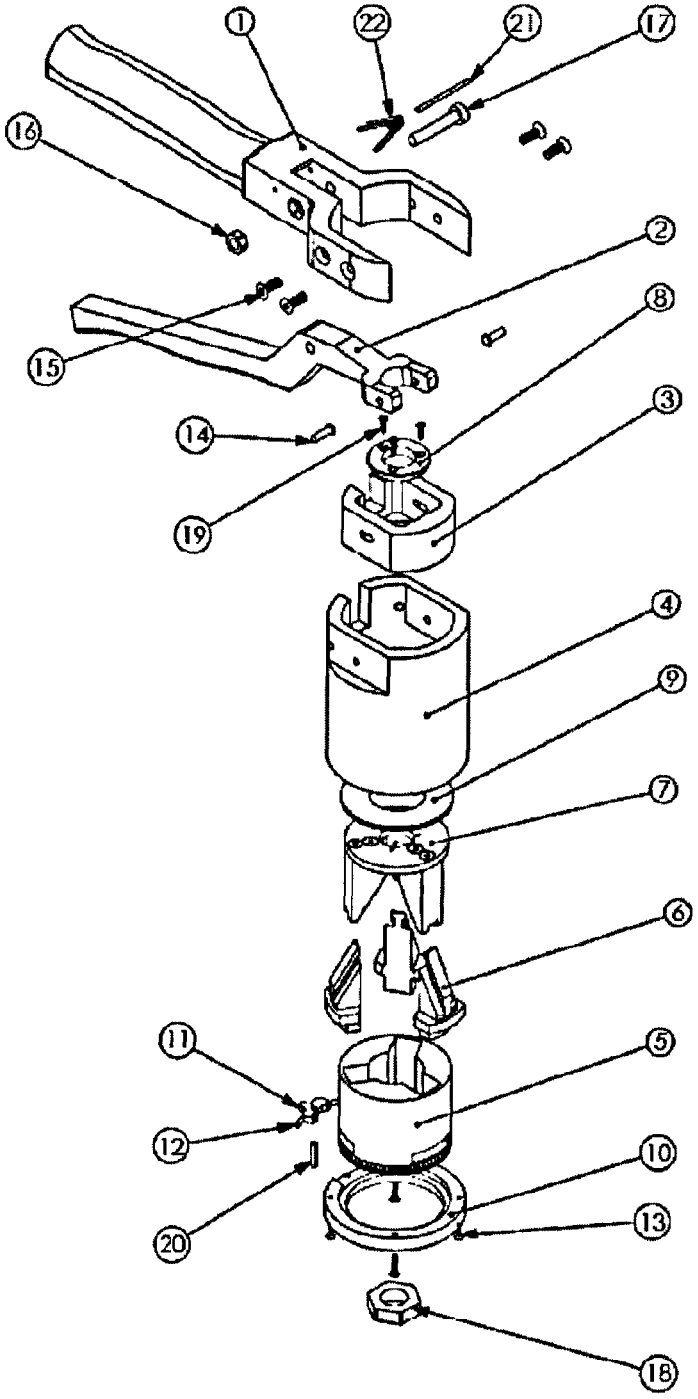
FIG. 1 is an exploded perspective view of different components of an exemplary ratcheting tool in accordance with the teachings of the present invention.
Figure 2:
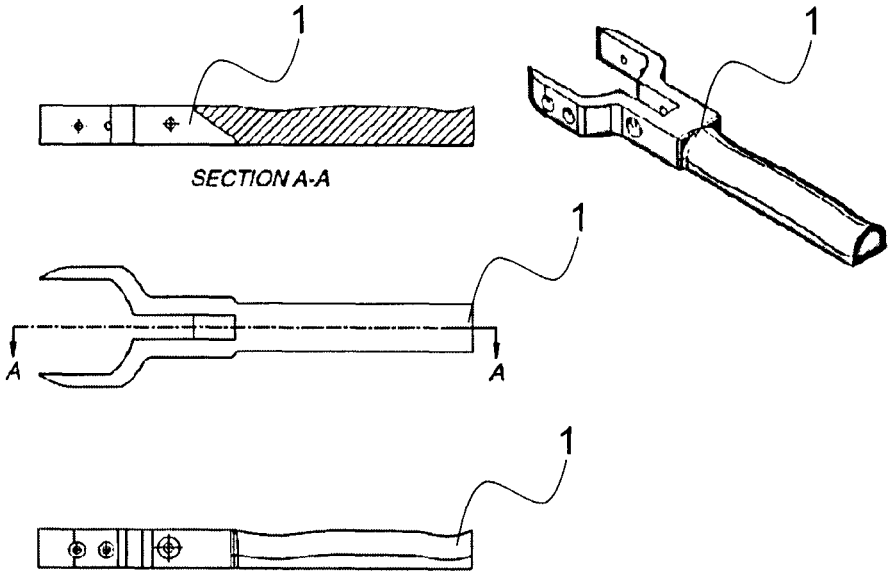
FIG. 2 provides a perspective view, a front view, a top view, and a front cross-sectional view of a handle of the ratcheting tool in one embodiment of the present invention.
Figure 3:
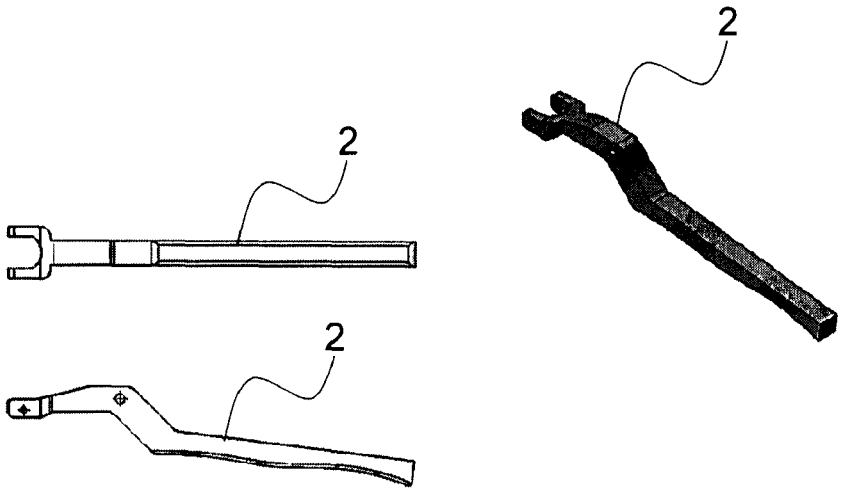
FIG. 3 provides a perspective view, a front view, and a top view of an arm of the ratcheting tool in one embodiment of the present invention.
Figure 4:
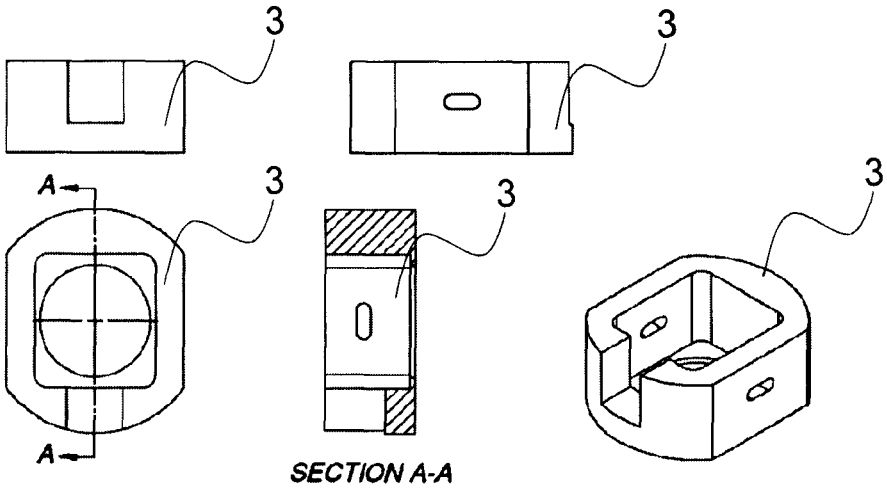
FIG. 4 provides a perspective view, a front view, a side view, a top view, and a cross-sectional view of a slider of the ratcheting tool in one embodiment of the present invention.
Figure 5:
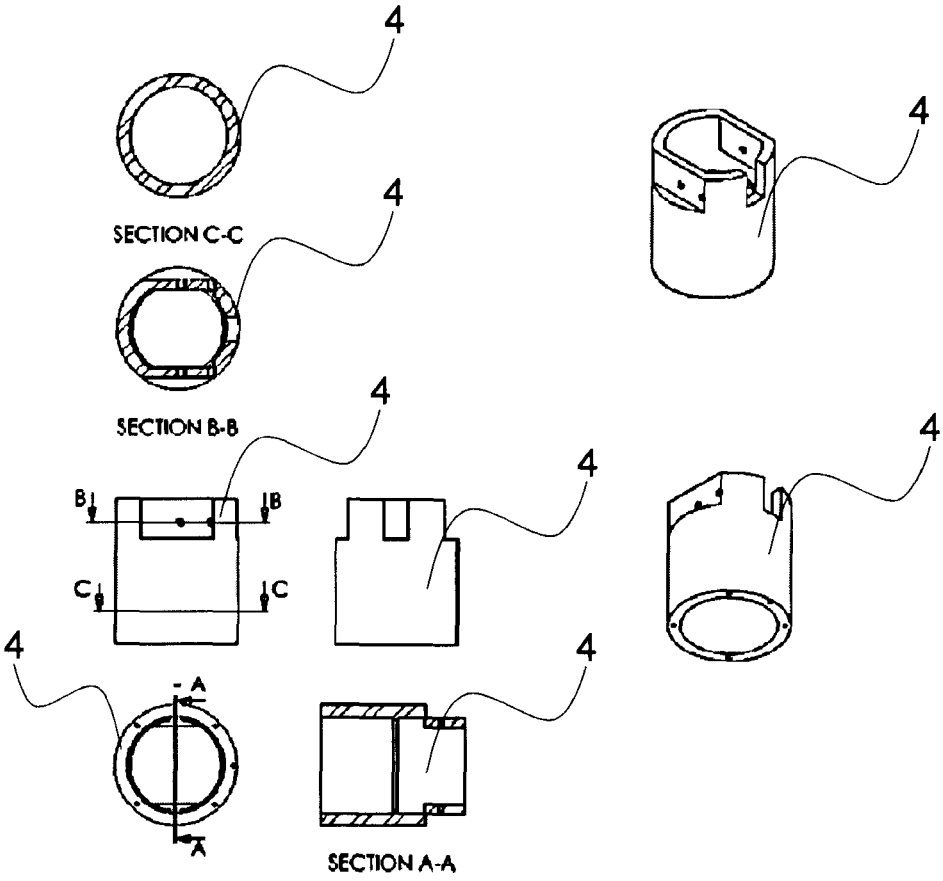
FIG. 5 provides a top perspective view, a bottom perspective view, a front view, a bottom view, two top cross-sectional views, and one side cross-sectional view of a case of the ratcheting tool in one embodiment of the present invention.
Figure 6:
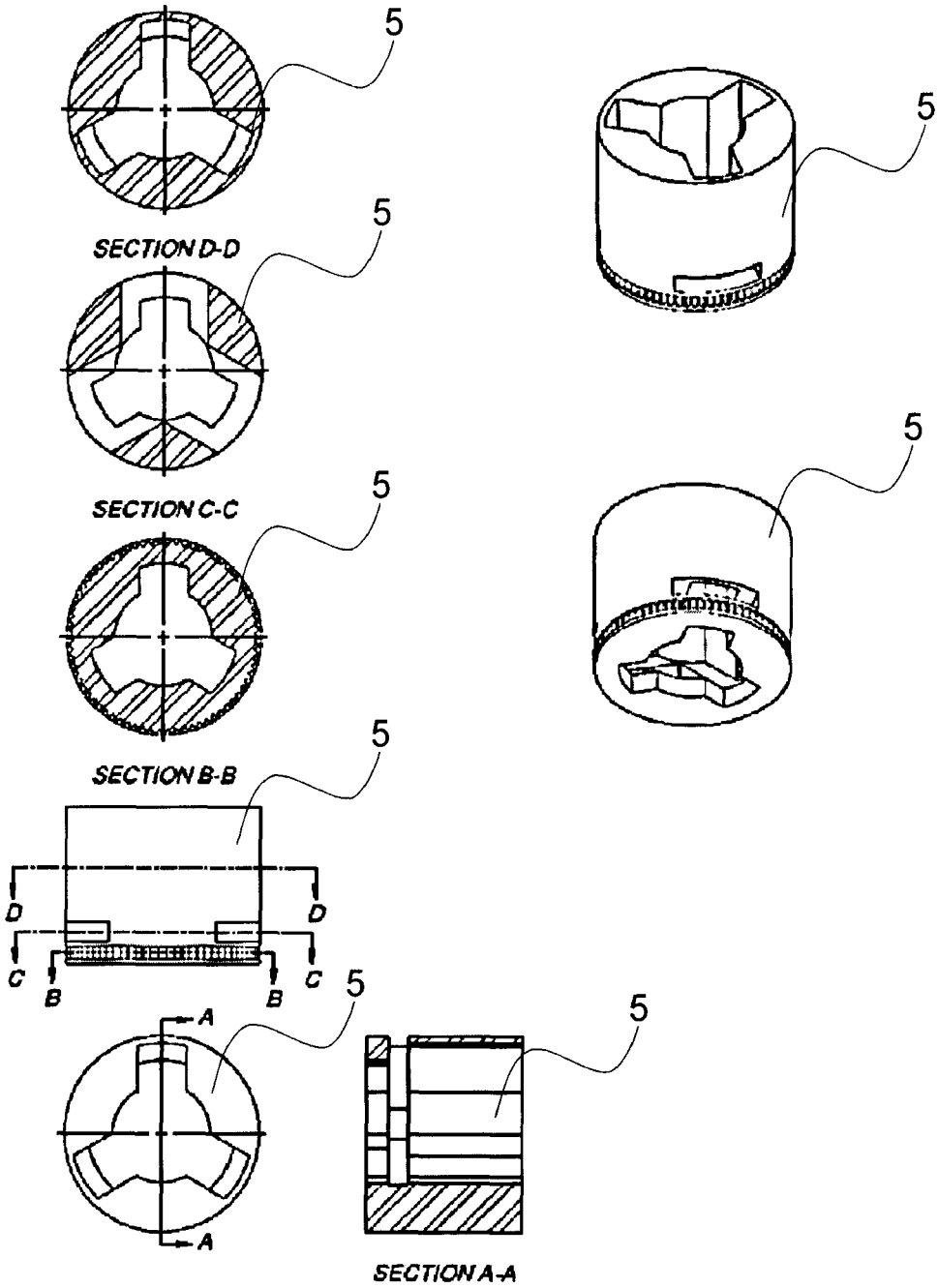
FIG. 6 provides a top perspective view, a bottom perspective view, a front view, a side view, a bottom view, three top cross-sectional views, and one side cross-sectional view of a block of the ratcheting tool in one embodiment of the present invention.
Figure 7:
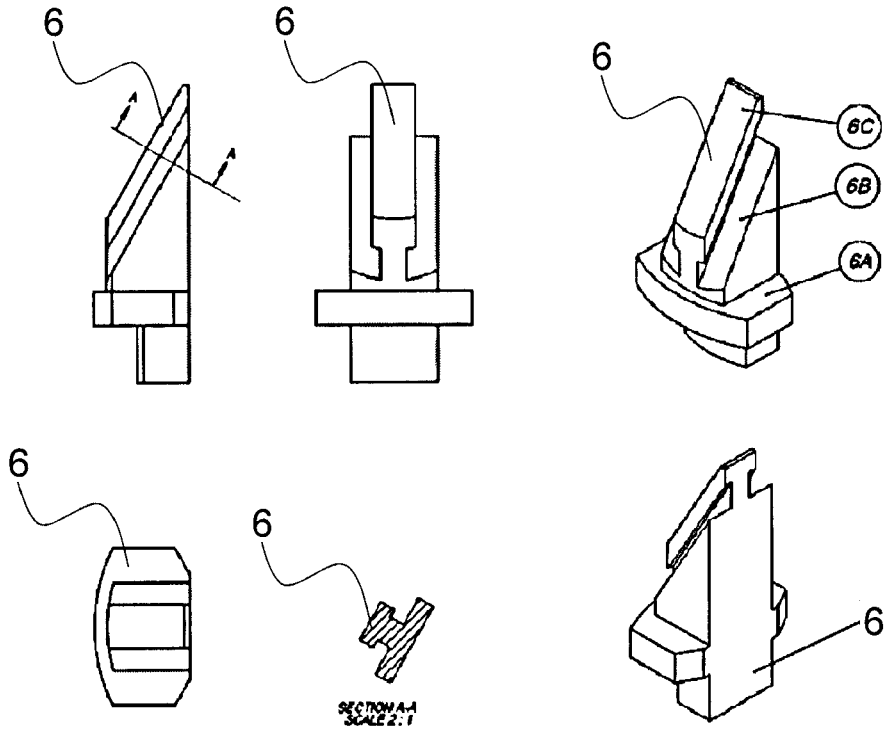
FIG. 7 provides a front perspective view, a rear perspective view, a front view, a side view, a top view, and a cross-sectional view of a jaw of the ratcheting tool in one embodiment of the present invention.
Figure 8:
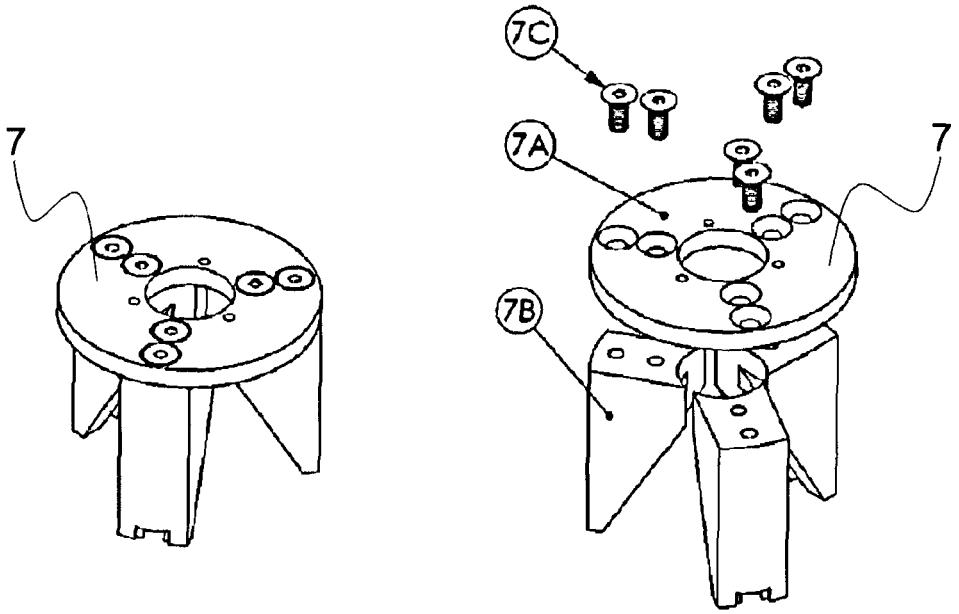
FIG. 8 provides a perspective view and an exploded perspective view of a pusher assembly of the ratcheting tool in one embodiment of the present invention.
Figure 9:
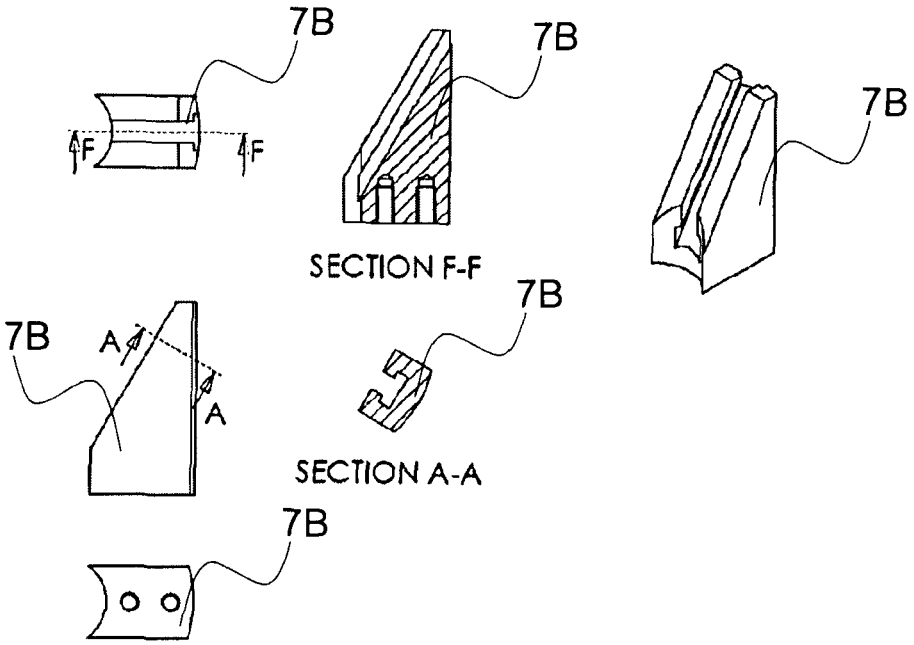
FIG. 9 provides a perspective view, a top view, a side view, a bottom view, a side cross-sectional view, and a bottom cross-sectional view of a pusher block of the ratcheting tool in one embodiment of the present invention.
Figure 10:
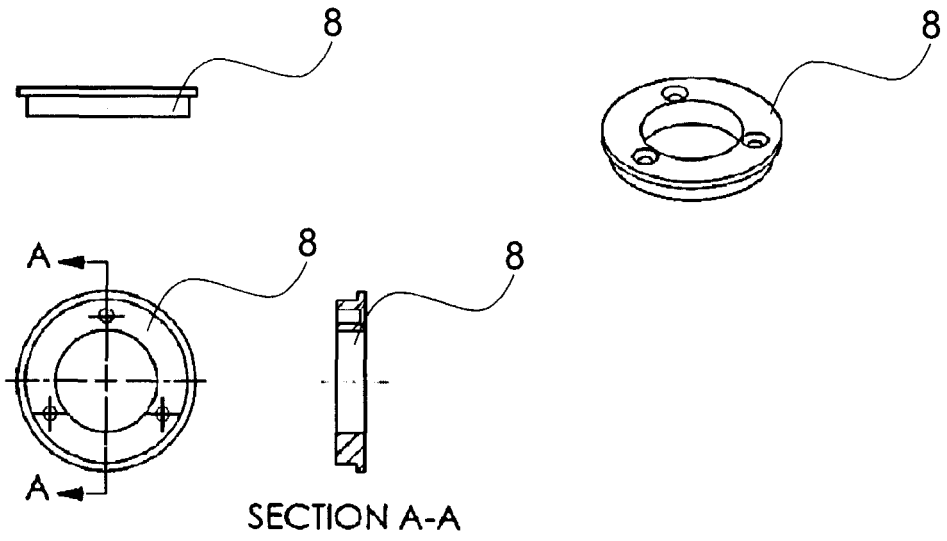
FIG. 10 provides a perspective view, a side view, a top view, and a cross-sectional view of a retractor of the ratcheting tool in one embodiment of the present invention.
Figure 11:
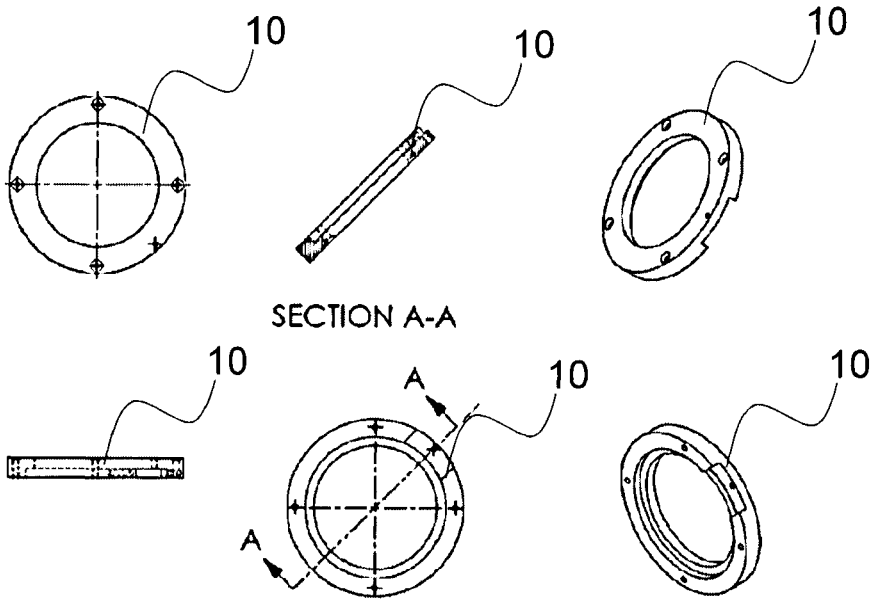
FIG. 11 provides a front perspective view, a rear perspective view, a top view, a side view, a bottom view, and a cross-sectional view of a bottom block of the ratcheting tool in one embodiment of the present invention.
Figure 12:
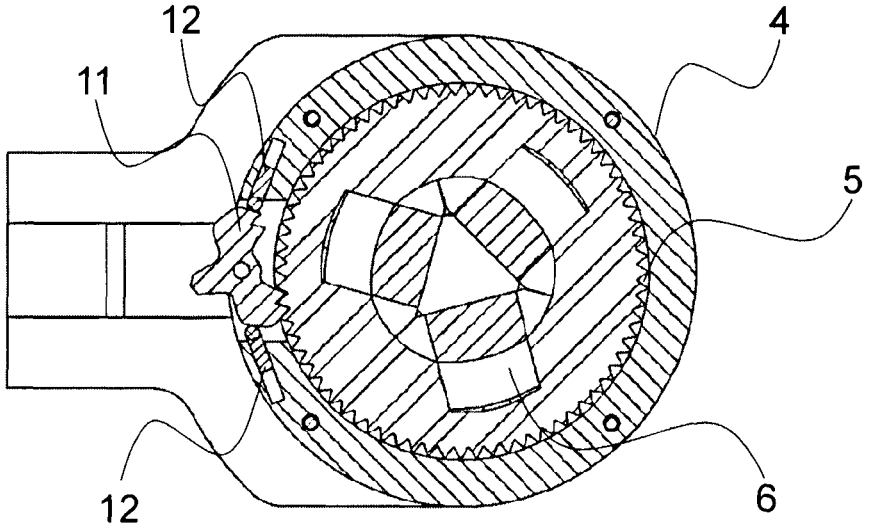
FIG. 12 is a first bottom cross-sectional view of a ratcheting mechanism of the ratcheting tool in accordance with the teachings of the present invention.
Figure 13:
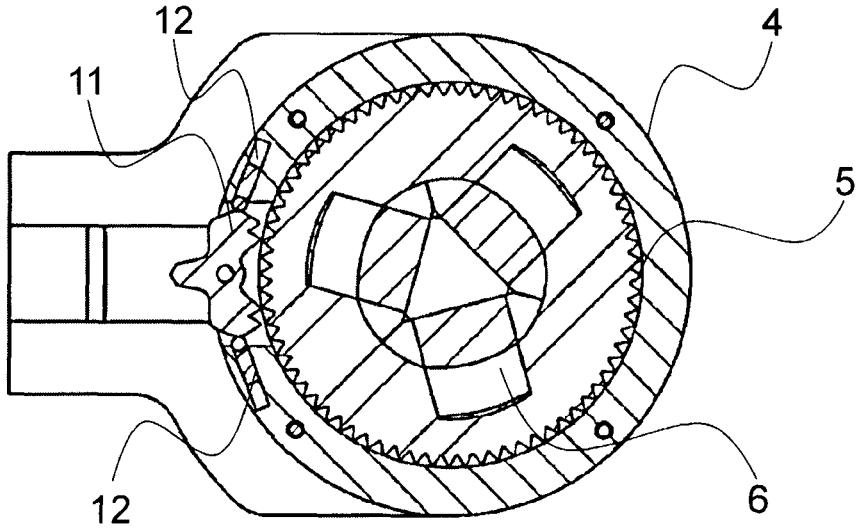
FIG. 13 is a second bottom cross-sectional view of the ratcheting mechanism of the ratcheting tool in accordance with the teachings of the present invention.

The following are the different components of an exemplary ratcheting tool:

1 Handle
2 Arm
3 Slider (or slider block)
4 Case
5 Block
6 Jaw
7 Pusher assembly
7B Pusher block
8 Retractor
9 Axial bearing
10 Bottom block
11 Ratcheting jaw
12 Ratcheting pin
13 Screws bottom
14 Pin arm
15 Screws handle
16 Nut handle
17 Bolt Handle
18 Nut (screw head)
19 Screw retractor
20 Pin ratcheting
21 Pin torsion spring
22 Torsion spring Referring to FIG. 1, there are 2 operations that will be described in detail below:

1—holding (pressing) the nut (screw) between the jaws inside the tool by pressing the arm 2 of the tool.

2—with the nut firmly hold in the tool, the ratcheting circular motion to tighten (or un-tighten) the nut on the rod (screw inside the threaded hole).

1—Holding (Pressing) the Nut:

The arm 2 is pressed toward the handle 1, rotating around the bolt 17, compressing the spring 22. Skilled persons will readily understand that the tool could be adapted to use a handle and an arm that could be squeezed sideways compared to the illustrated example.

Figure 14:
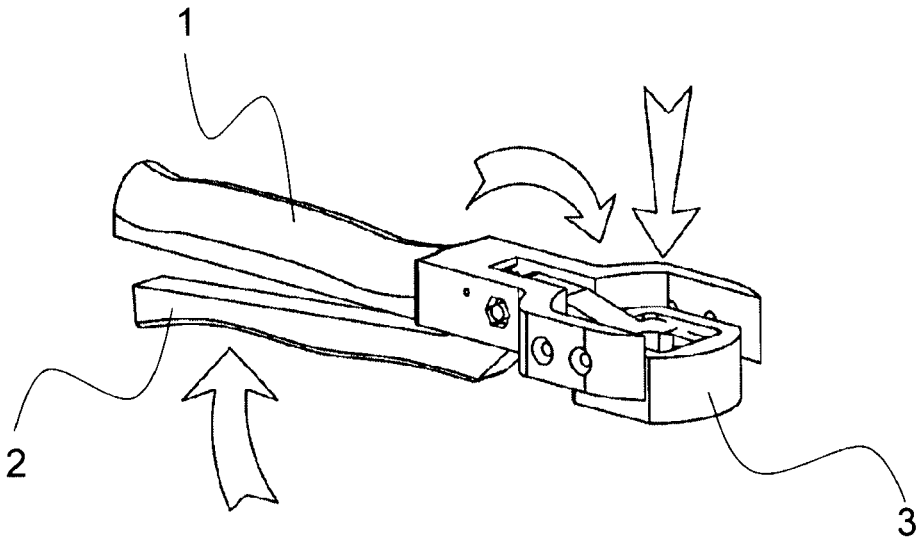
FIG. 14 is a perspective view of a front part of the arm of the ratcheting tool in accordance with the teachings of the present invention.

FIG. 14 depicts the front part of the arm 2 pushing the pins 14 downward.

Referring again to FIG. 1, the pins 14 are press fitted inside the holes of the arm 2. Persons skilled in the art will recognize that other shapes can be used instead of the arm 2 in order to obtain the same physical effect without departing from the present invention.

The pins are moving freely along the length inside the holes 3 of the slider, but the diameter of the pins is the same as the width of the channels on the slider.

The slider fits inside the case 4 and can have only a vertical translation, the rest of the degrees of freedom are blocked by the lateral flat faces and the inside round face of the case 4.

The pins 14 are pushing the slider 3 downward thru the channel surfaces.

The bottom face of the slider 3 is in contact with the thrust bearing 9.

The forces from the pins on the surface of the slider 3 are transmitted by the slider to the bottom surface of the slider 3.

The thrust bearing 9 transmits the axial pushing force from the upper face to the lower face.

The axial thrust bearing allows a free rotation between the top part and bottom part.

The bearing 9 transmits the axial force to the upper surface of the pusher assembly 7.

Figure 15:
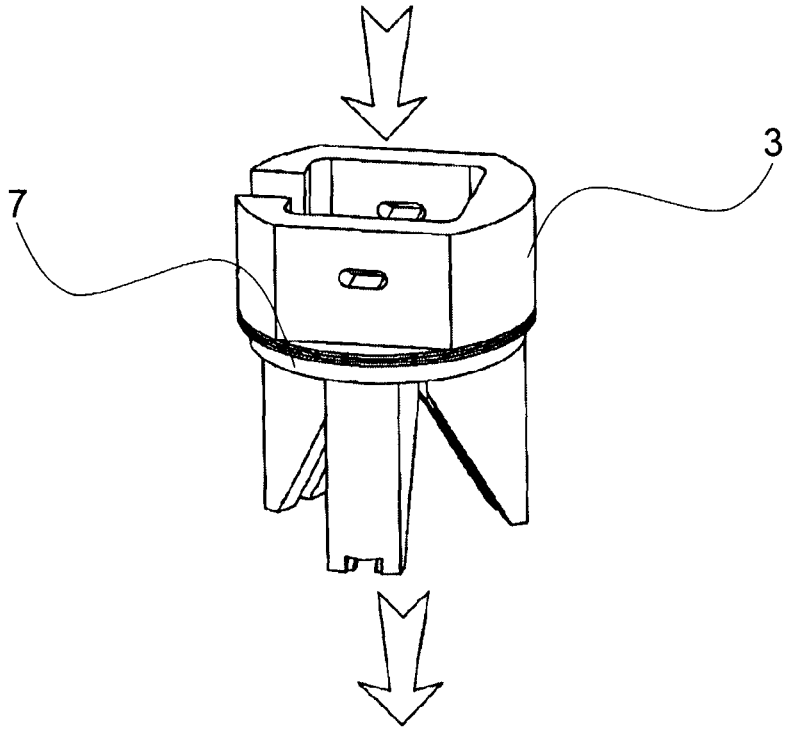
FIG. 15 is a perspective view of a cylinder of the ratcheting tool in accordance with the teachings of the present invention.

FIG. 15 depicts how the pusher assembly can rotate around the vertical axis and translate along the vertical axis, but has all the other degrees of freedom blocked by inside face of the case 4.

Referring again to FIG. 1, the channels on each of the pushers are guiding the jaws 6 with the T-channel, allowing a translation along the channel but blocking all the other degree of freedom. Skilled person will readily understand that other means than a T-channel could be used between the pusher and the jaws The force from the pusher assembly is transmitted downward to the upper surface of the jaws 6.

The jaws 6 are installed inside the block 5.

The channels inside the block 5 are guiding the jaws 6, allowing only a radial translation along the channels.

The block 5 is mounted inside the case 4 and has only one degree of freedom, the rotation around the vertical axis, the rest are blocked by the inside face of the case 4 and the bottom 10.

Figure 16:
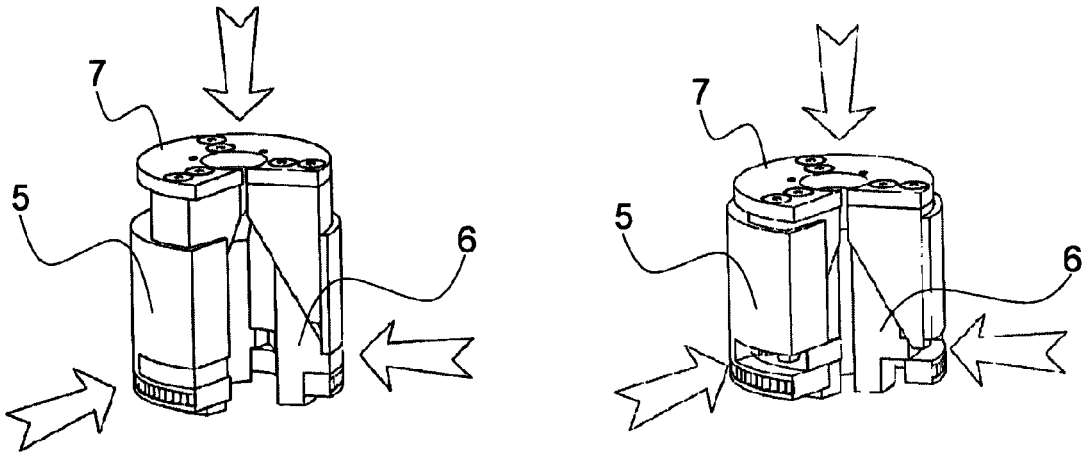
FIG. 16 provides two perspective views of the jaws of the ratcheting tool moving radially in accordance with the teachings of the present invention.
Figure 17:
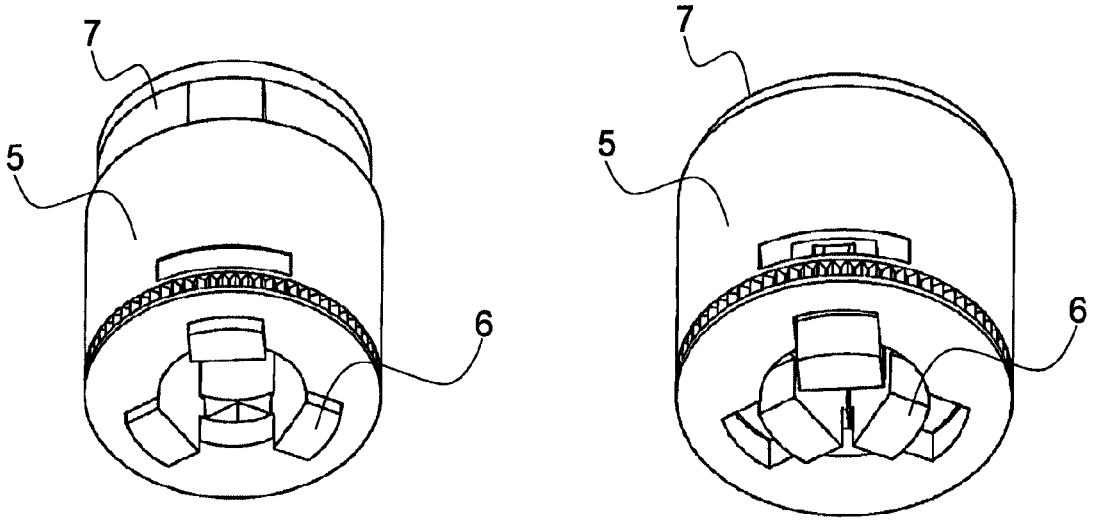
FIG. 17 provides two bottom perspective views of the jaws of the ratcheting tool moving radially in accordance with the teachings of the present invention.
Figure 18:
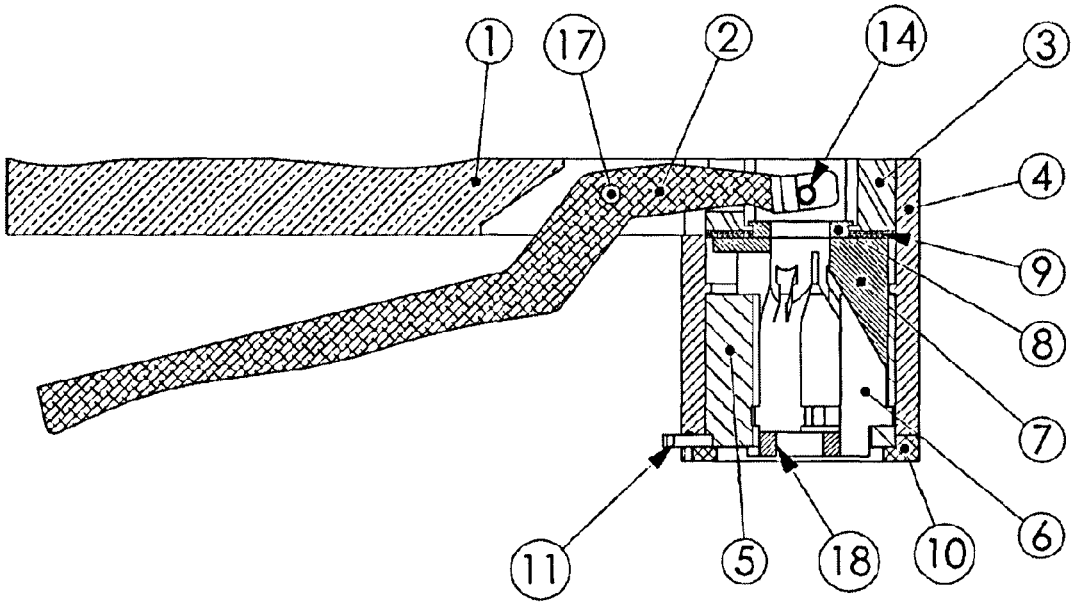
FIG. 18 is a side cross-sectional view of the ratcheting tool of one embodiment of the present invention.
Figure 19:
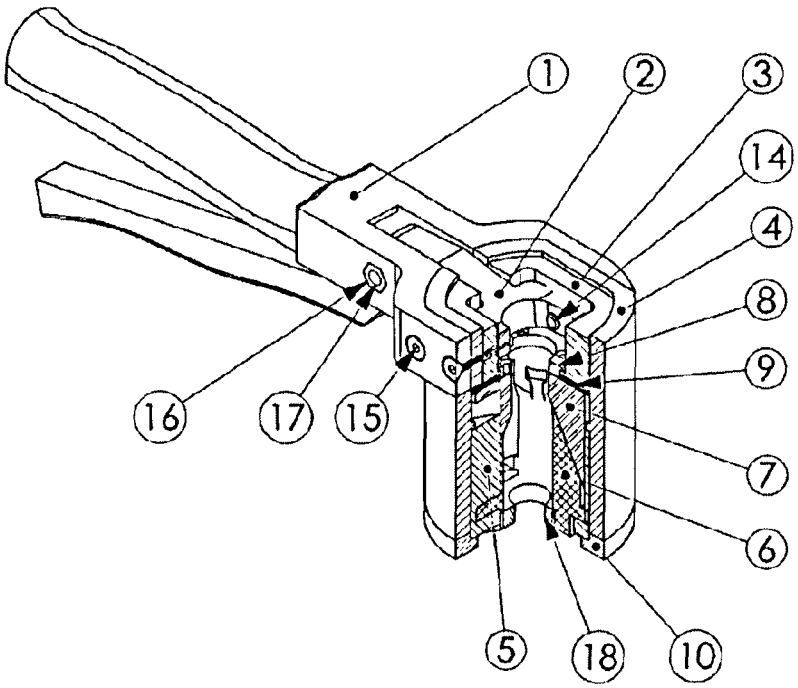
FIG. 19 is a perspective cross-sectional view of the ratcheting tool of one embodiment of the present invention.

FIGS. 16 and 17 depict the jaws 6, constrained by the channels in block 5 and the downward pressure from the pusher 7, moving radially inward along the channels toward the central axis, until they reach the nut.

Referring again to FIG. 1, the force from the arm 2 is transmitted to the nut 18, locking it inside the tool.

Opening:

The force on arm 2 is released, the spring 22 is pushing the arm 2 away from the handle 1.

Arm 2 is rotating around the pin 17.

Pins 14 are pulling the slider 3 up.

Slider 3 is pulling up the retainer 8.

Retainer 8 is pulling up the screws 19.

Screws 19 are pulling the pusher assembly 7.

Pusher assembly 7 is pulling the jaws 6.

Jaws 6 are constrained inside the channels of the block 5 to a translation.

The 2 constrains from the pusher assembly 7 and the block 5 are moving the jaws radially outward away from the central axis, releasing the nut.

2—Tightening the Nut Against the Rod:

The ratcheting mechanism 11 is in a tightening position, toward left, blocking the counter clock rotation of the block 5, jaws 6 and pusher assembly 7 inside the case 4. A temporary lock mechanism (not shown) could be used to maintain the handle and the arm at a given position once a grip has been achieved over the nut or bolt head.

The faces of the jaws 6 are pressed against the nut.

The jaws lateral faces are pushing against the block 5 faces.

The dents in the block 5 are pushing against the ratcheting 11.

The ratcheting 11 is pushing against the pin 20.

The pin 20 is pushing against the case 4.

The tool is rotating around the vertical axis in a clock wise movement, tightening the nut on the screw (or the screw in the hole).

Once the limit position was achieved, the tool rotates back around the vertical axis in a ratcheting, counter clock wise move.

The ratcheting mechanism 11 is allowed by the pins 12 and springs behind them to move back in a ratcheting motion over the dents in the block 5 and allows a clock wise rotation of the block 5 with the jaws 6 and the assembly pusher 7 inside the case 4.

The jaws 6 are holding the nut and the block 5 with the jaws 6, the pusher assembly and the lower part of the bearing 9 are in a fixed position.

The tool is rotating in a counter clock wise movement, until it reaches the limit position.

To un-tighten the nut, the ratcheting mechanism is switched toward right, allowing a relative counter clock wise rotation of the block 5, jaws 6 and pusher assembly 7 from the case 4, but blocking the clock wise rotation.

The illustrated example presents 3 jaws, but other embodiments could be made using 3, 4 or 6 jaws. The tool could also be used for tubular key to remove stripped (rounded) nuts or screws.

The invention as illustrated in this exemplary embodiment thus presents a combination between a ratcheting tool and an adjustable wrench. The following presents exemplary features and exemplary advantages that may be provided by the tool. Pressure on the nut can be maintain to a constant level, which has been noticed to lack on other tools that, once adjusted, may fail to keep constant pressure and may therefore slip or round the nut or head of bolt. The tool is designed for one hand operation. Skilled people will understand that changing the angle of the slide face on the jaws can increase the force exercised on the nut with a decrease in range, or can allow a smaller force on the nut but a wider range. The shape of the illustrated tool also allows for nuts to be tightened or released from longer screws, as the screw can be passed through the tool. Optionally, in order to diminish friction between the slider and the pusher and/or between block and bottom, trust washer or needle thrust bearing could also be added.

Figure 20:
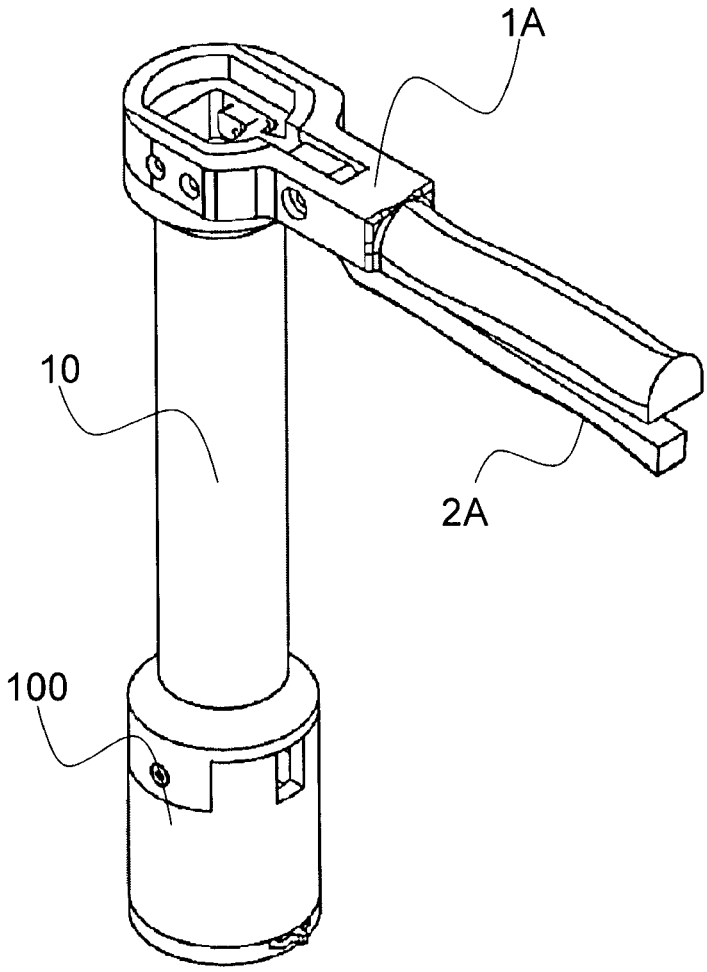
FIG. 20 is a perspective view of a ratcheting tool involving an extension in accordance with the teachings of the present invention.
Figure 21:
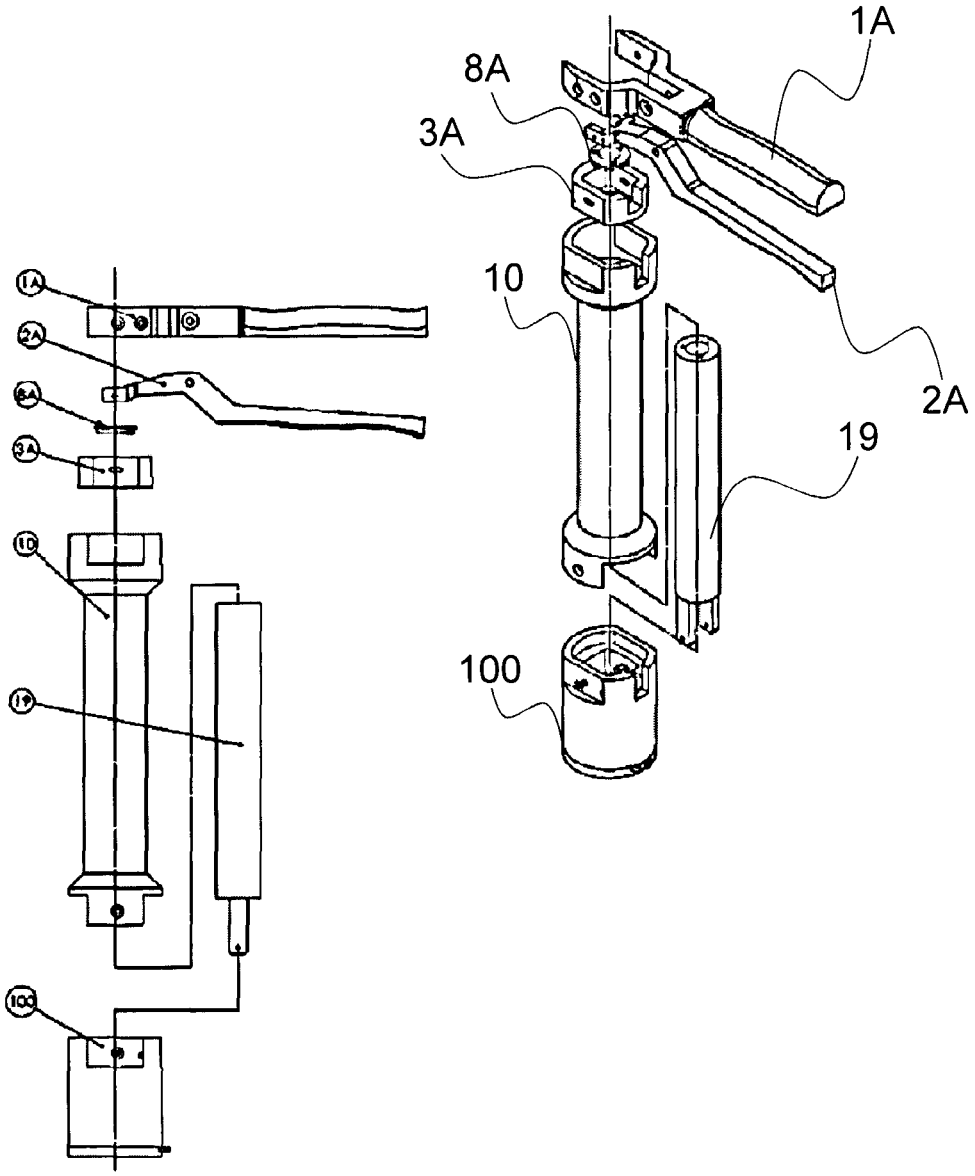
FIG. 21 provides an exploded side view and an exploded perspective view of the ratcheting tool involving the extension in accordance with the teachings of the present invention.

In another exemplary embodiment, an extension could also be added as illustrated in FIGS. 20 and 21. Functional characteristics mentioned before are equivalent, but the extended tool is likely more useful in tight spaces as force can be applied on the nut faces even at long distance.

It uses the same parts for head (100 on the next drawing), but between handle and case there is a tube 10 that extends the tool. For movement, there is another tube 19 inside that takes the movement from the slider 3 and extends it to the bottom slider.

In the exemplary embodiments, the ratcheting mechanism has been positioned close to the bottom (i.e., next to the nut) to give the maximum force and eliminate slack, but other positions can be made. Jaws can be made in different dimensions, shapes, number as long as they allow to transform the vertical movement in radial movement and as long as the other degrees of freedom are sufficiently eliminated. The tool has the main functions of applying a force on the nut to hold it and to allow the tightening/ratcheting movement. The tool allows ratcheting movement of the mechanism that holds the nut, while holding an active force on it. Vertical movement (longitudinal along the main axis of the cylinder) can be obtained in different modes, screw type, pushing mechanism longitudinal or from the side. The ratcheting mechanism is able to block the rotation in one way and allow it in the other way. The ratcheting mechanism can be made with different parts or different configurations. The extension part can be made in more lengths and may be a totally separated tool or as an extension of a normal tool.

The description of the present invention has been presented for purposes of illustration but is not intended to be exhaustive or limited to the disclosed embodiments. Many modifications and variations will be apparent to those of ordinary skill in the art. The embodiments were chosen to explain the principles of the invention and its practical applications and to enable others of ordinary skill in the art to understand the invention in order to implement various embodiments with various modifications as might be suited to other contemplated uses. the drawings are not necessarily drawn to scale.

The invention claimed is:

1. An apparatus for tightening or un-tightening a nut on a bolt comprising:

a handle with an arm;

a cylinder substantially perpendicular to the handle, the cylinder being adapted to be positioned over a nut or bolt head, the cylinder comprising jaws adapted to engage the nut or bolt head when pushed laterally theretowards, wherein, when the arm is squeezed with the handle, a slider block is pushed towards the nut or bolt head causing the jaws to laterally engage the nut or bolt head;

a pusher assembly defining a plurality of downward diagonal prisms;

a block defining a plurality of diagonal sliding channels corresponding to said prisms;

a ratcheting mechanism between the cylinder and the jaws that allows torque to be applied to the nut or bolt head in a desired direction when the handle is moved in a circular motion around the main axis of the cylinder, wherein the jaws are allowed to rotate within the cylinder in a direction opposite to the desired direction;

wherein the diagonal prisms each engaging one of the jaws within a diagonal sliding channel, the jaws moving inwardly by sliding within the sliding channels when the slider block is pushed towards the nut or bolt head.

2. The apparatus of claim 1, wherein the ratcheting mechanism is positioned within the cylinder.

3. The apparatus of claim 2, wherein the ratcheting mechanism is positioned within the cylinder on the same plane of the nut or bolt head.

4. The apparatus of claim 1, wherein the slider block is pushed perpendicularly towards the nut or bolt head.

5. A method for, using a device, tightening or un-tightening a nut on a bolt comprising:

(a) engaging the nut or bolt head in a cylinder of the device by pressing an arm of the device towards a handle of the device pushing a slider block towards the nut or bolt head, thereby causing a pusher assembly comprising a plurality of downward diagonal prisms each disposed within a corresponding diagonal sliding channel of a block within the cylinder to descend causing jaws within the cylinder to move inwardly until they reach and tighten around the nut or bolt head;

(b) while a ratcheting mechanism of the device is engaged in an active position, rotating the device in a first direction in which the nut or bolt head is rotated by the device while allowing rotation of the device in a second direction without the nut or bolt head being rotated;

(c) releasing the arm, thereby causing the pusher assembly to move up and the jaws to move away from the nut or bolt head.

6. The method of claim 5 further comprising, before or after (a):

switching the ratcheting mechanism of the device into the active position.

7. The method of claim 6 further comprising, after (c):

(d) switching the ratcheting mechanism of the device from the active position into a second active position.

8. The method of claim 6 further comprising, after (d):

(e) engaging the nut or bolt head in a cylinder of the device by pressing an arm of the device towards a handle of the device, thereby causing a pusher assembly within the cylinder to descend causing jaws within the cylinder to move inwardly until they reach and tighten around the nut or bolt head;

(f) rotating the device in the second direction in which the nut or bolt head is rotated by the device while allowing rotation of the device in the first direction without the nut or bolt head being rotated;

(g) releasing the arm, thereby causing the pusher assembly to move up and the jaws to move away from the nut or bolt head.

* * * * *